US007521075B2

(12) United States Patent
Scarabelli et al.

(10) Patent No.: US 7,521,075 B2
(45) **Date of Patent: *Apr. 21, 2009**

(54) SHEET MATERIAL FOR PRODUCING PACKAGES OF FOOD PRODUCTS, AND PACKAGES MADE OF SUCH MATERIAL

(75) Inventors: Paolo Scarabelli, Sesso (IT); Lorenzo Tacconi, Modena (IT); Giorgio Galavotti, Concordia Sulla Secchia (IT); Rickard Norenstam, Kavlinge (SE)

(73) Assignee: Tetra Laval Holdings & Finance SA, Pully (CH)

( * ) Notice: Subject to any disclaimer, the term of this patent is extended or adjusted under 35 U.S.C. 154(b) by 560 days.

This patent is subject to a terminal disclaimer.

(21) Appl. No.: 10/488,768

(22) PCT Filed: Oct. 31, 2002

(86) PCT No.: PCT/EP02/12209

§ 371 (c)(1),
(2), (4) Date: Mar. 5, 2004

(87) PCT Pub. No.: WO03/037722

PCT Pub. Date: May 8, 2003

(65) Prior Publication Data

US 2004/0197443 A1 Oct. 7, 2004

(30) Foreign Application Priority Data

Nov. 2, 2001 (IT) ..... TO2001A1045

(51) Int. Cl.
*B65B 25/006* (2006.01)

(52) U.S. Cl. ..... 426/87; 426/106; 53/51; 53/52; 53/433; 235/462.02; 235/490; 235/454; 235/455

(58) Field of Classification Search ..... 426/231, 426/232, 410, 87, 106; 53/51, 52, 433; 235/462.02, 235/490, 454, 455
See application file for complete search history.

(56) References Cited

U.S. PATENT DOCUMENTS

| | | | | |
|---|---|---|---|---|
| 2,483,155 | A * | 9/1949 | Salfisberg | 53/51 |
| 3,028,064 | A | 4/1962 | Thurlings | |
| 3,220,320 | A * | 11/1965 | Brigham | 493/11 |
| 3,276,183 | A * | 10/1966 | Carlisle, Jr. et al. | 53/51 |
| 3,453,799 | A * | 7/1969 | Cloud et al. | 53/455 |
| 3,497,576 | A * | 2/1970 | Dvorin | 264/2.7 |

(Continued)

FOREIGN PATENT DOCUMENTS

EP 0 761 546 A1 3/1997

(Continued)

*Primary Examiner*—Drew E Becker
*Assistant Examiner*—Steven Leff
(74) *Attorney, Agent, or Firm*—Buchanan Ingersoll & Rooney PC

(57) ABSTRACT

A sheet material for producing packages of food products and having a succession of optically detectable register mark; each mark, has a first and a second segment parallel to each other and perpendicular to a feed direction of the material, and a sloping segment interposed between the parallel segments, so as to define a broken, to substantially Z-shaped line, which may be used to determine the position of the material both in the feed direction and in a perpendicular direction.

14 Claims, 3 Drawing Sheets

U.S. PATENT DOCUMENTS

| | | | | | |
|---|---|---|---|---|---|
| 3,788,028 | A | * | 1/1974 | Folkesson et al. | 53/51 |
| 4,081,944 | A | * | 4/1978 | Sjostrand | 53/51 |
| 4,184,700 | A | * | 1/1980 | Greenaway | 283/91 |
| 4,329,573 | A | * | 5/1982 | Greene | 235/454 |
| 4,545,780 | A | * | 10/1985 | Martin | 493/11 |
| 4,625,101 | A | * | 11/1986 | Hinks et al. | 235/462.01 |
| 4,747,253 | A | * | 5/1988 | Schulte | 53/433 |
| 4,775,169 | A | * | 10/1988 | Barth | 283/115 |
| 5,059,776 | A | * | 10/1991 | Antes | 235/462.01 |
| 5,067,307 | A | * | 11/1991 | Francioni et al. | 53/450 |
| 5,101,184 | A | * | 3/1992 | Antes | 235/454 |
| 5,393,967 | A | * | 2/1995 | Rice et al. | 235/454 |
| 6,130,099 | A | * | 10/2000 | Kielmann | 436/501 |
| 6,397,557 | B1 | * | 6/2002 | Bassissi et al. | 53/51 |
| 6,751,925 | B1 | * | 6/2004 | Kinoshita et al. | 53/51 |
| 2004/0259709 | A1 | | 12/2004 | Guidotti et al. | |

FOREIGN PATENT DOCUMENTS

| | | | |
|---|---|---|---|
| FR | 2377661 | * | 9/1978 |
| JP | 08058745 A | * | 3/1996 |
| JP | 09236487 A | * | 9/1997 |

* cited by examiner

SHEET MATERIAL FOR PRODUCING PACKAGES OF FOOD PRODUCTS, AND PACKAGES MADE OF SUCH MATERIAL

TECHNICAL FIELD

The present invention relates to a sheet material for packaging food products.

BACKGROUND ART

Materials are known for packaging pourable food products, such as fruit juice, wine, tomato sauce, pasteurized or long-storage (UHT) milk, etc.

The packages are formed from a continuous web of packaging material. According to one known technique, the web is longitudinally sealed to form a continuous tube.

The packaging material has a multilayer structure comprising a layer of paper material covered on both sides with layers of heat-seal material, e.g. polyethylene, and, in the case of aseptic packages for long-storage products, such as UHT milk, also comprises a layer of barrier material defined, for example, by an aluminium film, which is superimposed on a layer of heat-seal plastic material and in turn covered with another layer of heat-seal plastic material eventually defining the inner face of the package contacting the food product.

To produce aseptic packages, the web of packaging material is unwound off a reel and fed through an aseptic chamber in which it is sterilized, e.g. by applying a sterilizing agent such as hydrogen peroxide, which is later vaporized by heating and/or by subjecting the packaging material to radiation of appropriate wavelength and intensity.

The sterilized web is then folded into a cylinder and sealed longitudinally to form, in known manner, a continuous, vertical, longitudinally sealed tube. The tube of packaging material, in other words, forms an extension of the aseptic chamber, and is filled continuously with the pourable food product and then fed to a form-and-seal unit for forming the individual packages and on which pairs of jaws grip and seal the tube transversely to form pillow packs.

The pillow packs are then separated by cutting the sealing portion between the packs, and are fed to a final folding station where they are folded mechanically into the shape of the finished packages.

The various operations in the packaging material manufacturing process are performed using, as a reference, a register mark or marks printed on the material at the first printing stage.

The register mark or marks include a printed code that is normally also used on the forming machine to control feed of the material through the various work stations. More specifically, as is known, a so-called "decoration correcting" device acts on the packages being formed to variously "draw" the material in the feed direction and ensure performance of the mechanical forming operations matches the decoration on the packages.

On known packaging machines, before the web is sealed longitudinally to form the tube, the transverse position of the web must normally also be controlled, e.g. to perform auxiliary operations, such as cutting and applying removable tabs or opening devices.

It is also necessary to control the angular position of the tube on the sealing unit, which may vary, in use, with respect to the desired angular position, on account of the lateral edges of the web not being perfectly straight, of the effect produced by the pairs of jaws successively striking the tube, and of the effects due to the web tensioning variations.

As this may have negative effects on the quality of the longitudinal and transverse seals, and on the accuracy with which the packages are formed, known machines are provided with devices for manually adjusting the angular position of the tube. Such devices, however, are relatively time-consuming, and may involve shutting down the machine with consequent loss of production. Systems have also been proposed for automatically adjusting the angular position of the tube of packaging material, but call for the use of a dedicated sensor to determine the position of the superimposed material layers at the longitudinal seal.

DISCLOSURE OF THE INVENTION

It is an object of the present invention to provide a sheet packaging material for producing packages of food products, and which comprises optically detectable register marks by which to determine the position of the material both in the feed direction on the machine and transversely.

According to the present invention, there is provided a sheet material for producing packages of food products and comprising a number of fold lines, and a succession of optically detectable register marks; characterized in that each register mark comprises at least two parallel segments perpendicular to a feed direction of said material; and a sloping segment interposed between the parallel segments.

According to the invention, as the material is fed through the machine, the register marks can be detected by one or more optical sensors for controlling the position of the web at a respective work station and connected to a processing and control unit for controlling devices governing the position of the web. The sloping segment, together with the two segments transversal to the feed direction, indicates the transverse position of the material, which may be used to automatically correct both the transverse position of the flat web and the angular position of the tube.

Another problem typically associated with known packaging materials is the following:

The packages are formed by folding the packaging material along fold lines "creased" into the material. Though formation of the packages must match the fold lines, packaging material feed on the forming machine is normally controlled on the basis of register marks printed on the material.

The reason for this lies in conventional direct optical detection of the fold lines still posing problems for which a satisfactory solution has not yet been devised.

Creasing and printing are performed at different stages in the material production cycle, so that register tolerances between the two are inevitable. Using printed register marks as position references for operations which should match the fold lines therefore inevitably results in errors.

According to a preferred embodiment of the invention, the optically detectable register marks are defined by compression-creased fold lines having a recessed profile on a first face of the material, and a nonconvex profile on a second face of the material.

As compared with known creasing methods, compression creasing provides for obtaining much clearer compression lines which are detectable optically and can therefore be used as register marks.

According to a preferred embodiment of the invention, the material also comprises a decoration having a printed area at least partly enclosing one or more compression-creased fold lines, so that the fold lines in the printed area define optically detectable, "negative-printed" marks.

When printed using any known printing technique, the packaging material is compressed between a print cylinder and a counter-cylinder. If a conventional creasing method is used, the convex profile of the crease on the counter-cylinder side produces thrust resulting in accidental, undesired contact between the packaging material and print cylinder on the concave side of the crease line, thus resulting in lines with blurred profiles which are substantially undetectable optically.

Compression creasing, on the other hand, also produces a flat or slightly concave profile on the face of the packaging material contacting the counter-cylinder, thus eliminating thrust, and the recessed opposite side of the fold line is definitely ink-free, thus obtaining a high-contrast mark perfectly detectable by an optical sensor.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 2:
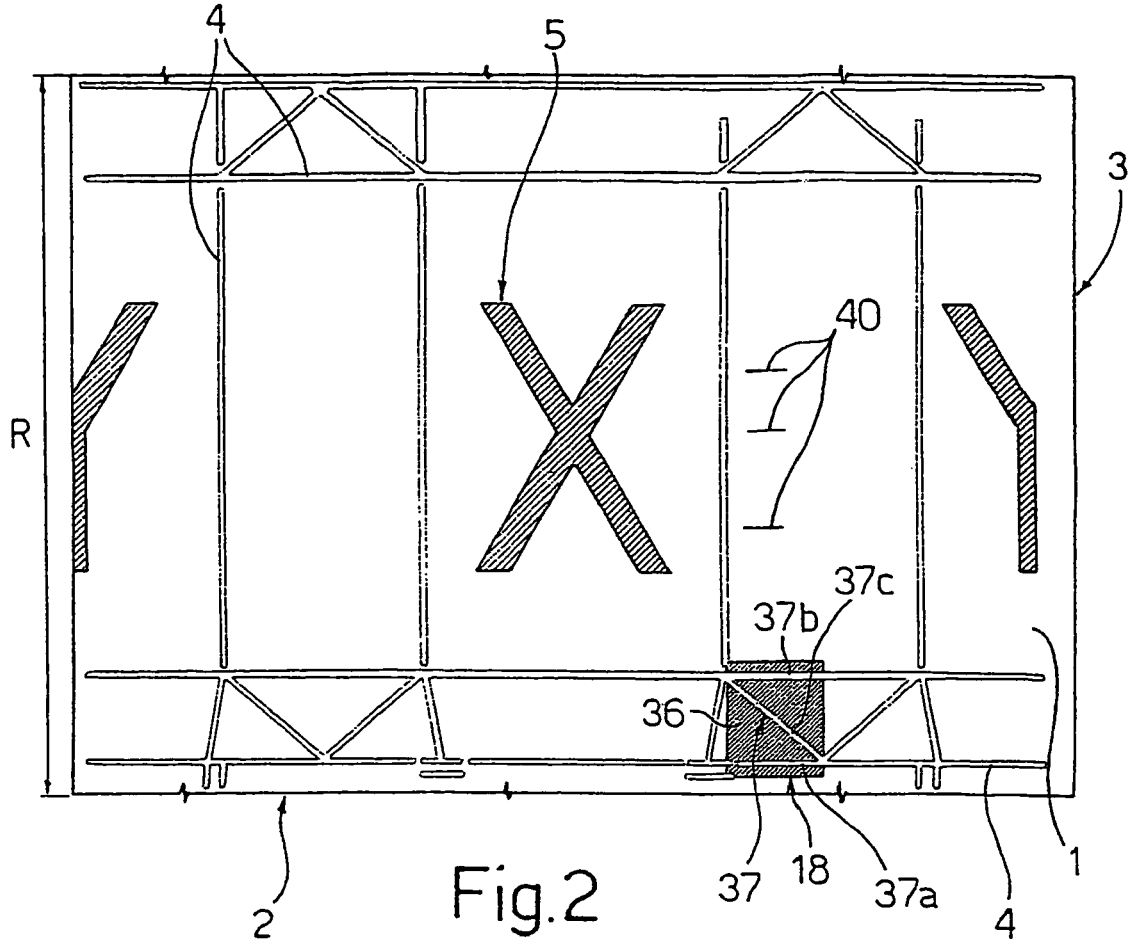
FIG. 2 shows a portion of a sheet packaging material in accordance with the present invention.

Number 1 in FIG. 2 indicates a portion of a sheet packaging material 2 fed in the form of a continuous web 3.

Web 3 of material 2 comprises a number of fold lines 4 and a printed decoration 5, which are repeated at intervals R equal to the length of material required to produce one package.

Figure 1:
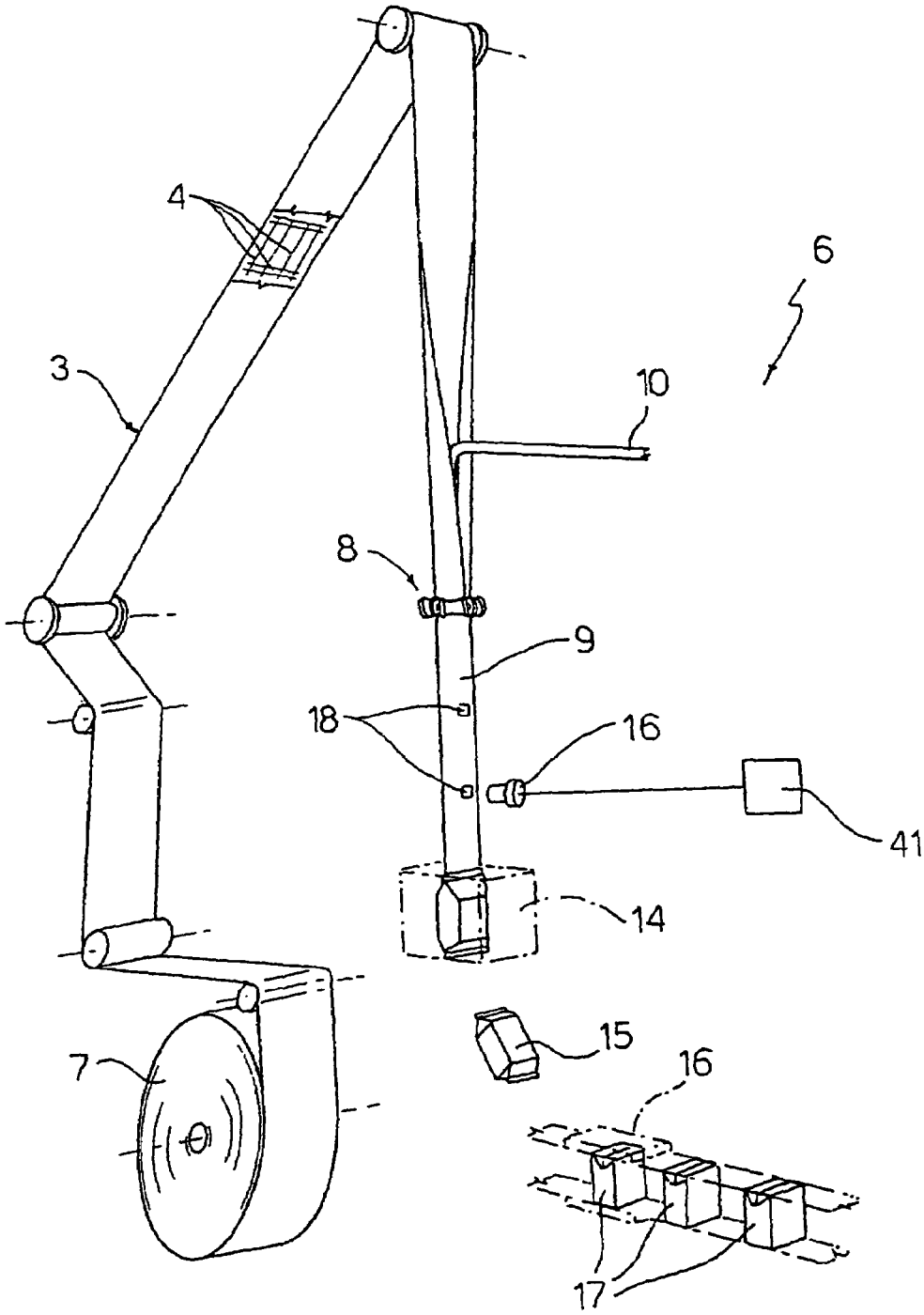
FIG. 1 shows, schematically, a machine for producing aseptic packages from a web of sheet material in accordance with the present invention.

Web 3 can be used on a machine 6, shown schematically in FIG. 1, for producing aseptic packages, and on which web 3 is unwound off a reel 7 and fed through an aseptic chamber (not shown), where it is sterilized, and through an assembly 8 by which it is folded and sealed longitudinally to form, in known manner, a continuous vertical tube 9.

Tube 9 of packaging material is filled continuously with the pourable food product by means of a known filling device 10, and is then fed to a forming and transverse sealing station 14 where it is gripped between pairs of jaws. (not shown) which seal the tube transversely to form pillow packs 15.

Pillow packs 15 are then separated by cutting the sealing portion between the packs, and are fed to a final folding station 16 where they are folded mechanically to form the finished packages 17.

The packages are formed by folding the material along fold lines 4, and by controlling material feed by means of an optical sensor 16 for "reading" register marks 18 located on the material at intervals R.

According to the present invention, each register mark 18 comprises a broken, substantially Z-shaped register line 37 defined by a first and a second segment 37*a*, 37*b* parallel to each other and perpendicular to the feed direction of web 3 on machine 6, and a segment 37*c* sloping with respect to segments 37*a*, 37*b*.

Consequently, as web 3 is fed through machine 6, register mark 18 can be detected by one or more optical sensors 16 for controlling the position of web 3 at a respective work station and connected to a processing and control unit 41 for controlling known devices (not shown) governing the position of web 3.

Using a Z-shaped register line 37, the position of web 3 can be controlled both in the feed direction and transversely, e.g. to correct the transverse position of the still-flat web—to perform auxiliary operations such as cutting and applying removable tabs or opening devices—or to correct the angular position of tube 9.

Furthermore, control of the lateral alignment is enabled during the process of applying the adhesive strip to one web edge in order to longitudinally seal the web and form a tube, as well as control of the alignment of superimposed web edges in the case of web splicing.

Optical sensor 16, in fact, successively detects first segment 37*a*, sloping segment 37*c*, and second segment 37*b* of the line; control unit 41 calculates a first time T1 between detection of first segment 37*a* and sloping segment 37*c*, and a second time T2 between detection of sloping segment 37*c* and second segment 37*b*; and the transverse position error of web 3 can be calculated and corrected on the basis of the T1 to T2 ratio. More specifically, if sensor 16 is located in the mid-plane of register marks 18, in the correct or reference position of web 3, the correct transverse position of the web corresponds to a T1/T2 ratio of 1. If the ratio is less than or greater than 1, the web can be moved transversely in known manner in the appropriate direction to reduce the position error.

It is similarly possible to calculate the lateral position error of web 3 from the ratio between T1 or T2 and total time T1+T2. In this case, the value 0.5 indicates the centre, while different values indicate lateral displacements.

Figure 3:
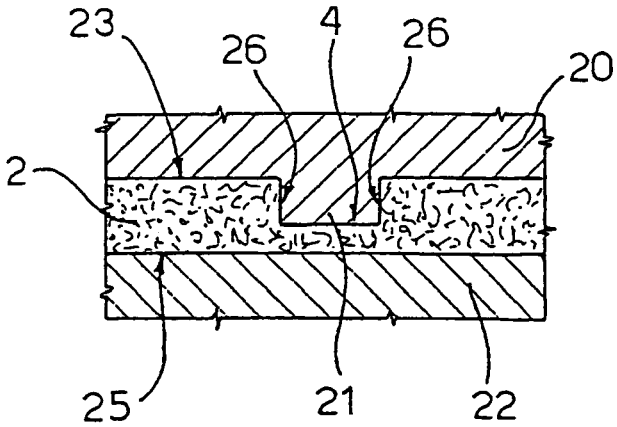
FIGS. 3 and 4 show, schematically, respective steps in a method of producing the FIG. 2 material.

Fold lines 4 are conveniently defined by compression lines formed by means of a compression creasing process (FIG. 3).

More specifically, material 2 is compressed between a creasing roller 20—the profile of which is shown partly, in plan form in FIG. 3, and has a number of projections 21 corresponding with compression lines 4—and a smooth reaction roller 22, i.e. with no cavities corresponding with projections 21. Conveniently, roller 20 operates on the face 23 of the material defining the outer surface of the package, i.e. on which decoration 5 is printed, and roller 22 on the opposite face 25.

The height of projections 21 ranges between 50% and 90%, and is preferably about 80%, of the thickness of material 2. The thickness of the material is reduced by the same percentage during compression, after which, the material recovers partly, but retains a permanent compressive set. The residual depth of the compression lines conveniently ranges between 30% and 60% of the thickness of material 2, and equals about 50% of the thickness when roughly 80% deformation is imposed during creasing.

Figure 4:
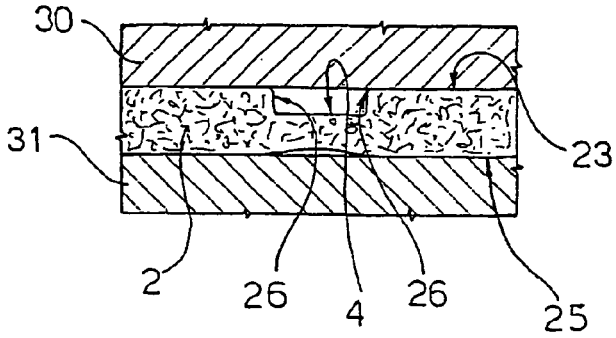

As shown clearly in FIG. 4, compression lines 4 have a recessed profile, defined laterally by step sides 26, on face 23 of material 2, and a substantially flat or slightly concave profile on the opposite face 25.

FIG. 4 also shows, schematically in plan form, the profiles of a print roller 30 and a counter-roller 31 respectively contacting faces 23 and 25 of material 2 at a compression line 4.

As shown clearly in FIG. 4, the substantially flat or slightly concave profile of compression line 4 on the side facing counter-roller 31 eliminates thrust on material 2 which may result in the thinner portion of the material being brought into contact with print roller 30.

Print roller 30 therefore only contacts the surface of material 2 outside compression line 4, which therefore appears as a sharp "negative-printed" line on the material.

This property of compression creasing may, in a preferred embodiment of the present invention, be exploited to obtain register marks 18 corresponding perfectly with compression lines 4. For example, with reference to FIG. 2, register mark 18 may be defined by a rectangular area 36 printed on the portion of material 2 eventually defining the bottom of finished package 17. Area 36 encloses part of compression lines 4—in particular, Z-shaped line 37 defined by segments 37*a*, 37*b*, 37*c* of compression lines 4—so as to define register mark 18 with and by contrast with line 37.

Z-shaped line 37 is thus "negative-printed" in area 36 forming part of decoration 5.

Material 2 (FIG. 2) is conveniently provided with optically detectable marks 40 for read-enabling optical sensor 16, so as to prevent mark 18 (which produces three variably spaced readings) from being "confused" with other marks defined by decoration 5, lines 4, or combinations of these.

Marks 40, which may be printed or creased, may be defined by a register code or two or more lines perpendicular to the feed direction and spaced a predetermined distance apart. The register code may be located in any convenient position on the web.

Processing unit 41 may be programmed, for example, to only open a read window—sized to definitely comprise the reading of register mark 18—after a predetermined time interval and/or distance from when the known succession of marks 40 with a given spacing has been read.

Figure 5:
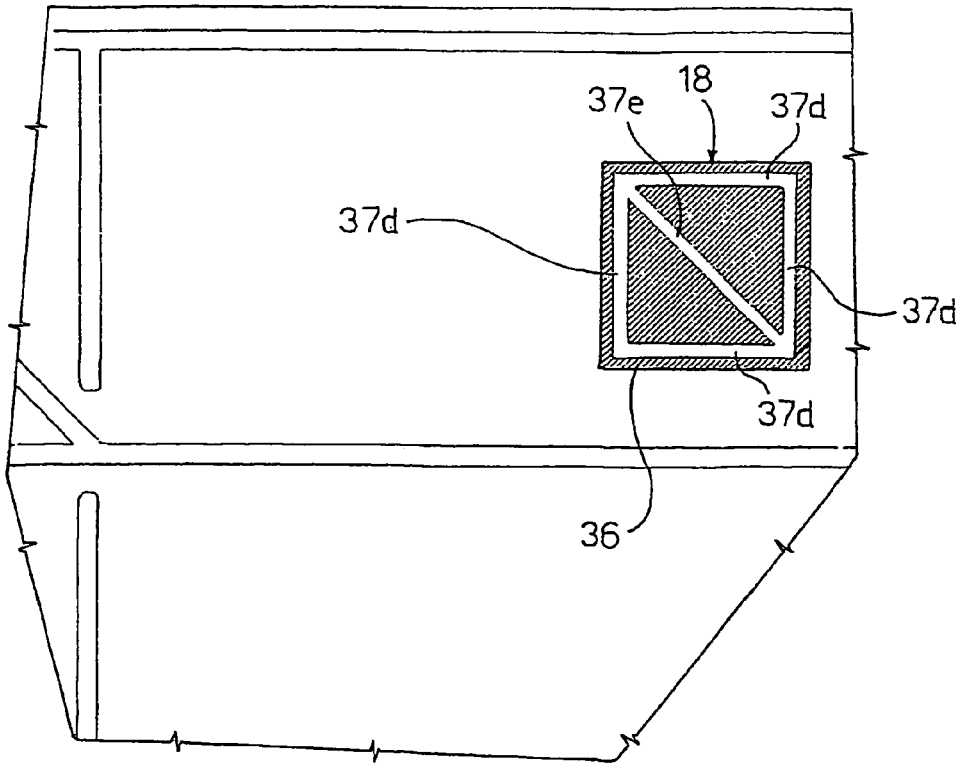
FIG. 5 shows a portion of a packaging material in accordance with a further embodiment of the invention.

In the FIG. 5 variation, register mark 18 is defined by compression lines 4 formed solely for that purpose, i.e. playing no part in the formation of the package, and conveniently comprises a square printed area 36 enclosing four compression lines 37*d* forming a square, and a compression line 37*e* along the diagonal of the square.

The mark can thus be "read" in exactly the same way as Z-shaped register line 37, but, being square, can be read in two perpendicular material feed directions X, Y with respect to an optical sensor 16.

This may be useful, for example, to use mark 18 as a register on a unit for applying opening devices to finished packages 17, and on which the packages are fed forward differently oriented.

Clearly, changes may be made to material 2 as described herein without, however, departing from the scope defined in the accompanying claims.

In particular, if the contrast obtained by compression creasing is sufficient, printed area 36 may be omitted and the crease read directly.

Moreover, the material may be provided with Z-shaped or square-and-diagonal register marks printed positively or negatively in conventional manner, as opposed to compression-creased.

The invention claimed is:

1. A sheet material for producing packages of food products and comprising a number of fold lines, and at least one optically detectable register mark; wherein said register mark comprises at least two parallel segments perpendicular to a feed direction of said material, the parallel segments allowing detection of the sheet material in a feed direction along which the sheet material is fed during production of the packages; and a sloping segment interposed between the parallel segments, the sloping segment allowing detection of the sheet material in a direction perpendicular to the feed direction, wherein said fold lines are compression lines having a recessed profile on a first face of the material and a nonconvex profile on a second face of said material, wherein each of said parallel segments forming a part of the optically detectable register mark is defined by at least a portion of one of said compression lines, and wherein the sloping segment forming at least a part of the optically detectable register mark is defined by at least a portion of one of the compression lines, the sheet material further comprising at least one printed area at least partly enclosing said compression lines and defining, with said compression lines and in contrast to said compression lines, said register mark.

2. A material as claimed in claim 1, wherein said register mark comprises four segments arranged to form a square; and a sloping segment along the diagonal of the square.

3. A material as claimed in claim 1, comprising a printed decoration.

4. A material as claimed in claim 3, wherein said optically detectable register mark forms part of said decoration.

5. A material as claimed in claim 1, comprising optically detectable marks for enabling reading of said register mark.

6. A material as claimed in claim 1, wherein at least a portion of two of the fold lines constitute the two parallel segments, and wherein at least a portion of one of the fold lines constitutes the sloping segment that is other than perpendicular to the feed direction.

7. A package containing a food product and formed from a sheet material folded along fold lines; said package comprising an optically detectable register mark; wherein said register mark comprises at least two parallel segments, the parallel segments allowing detection of the sheet material in a feed direction of the sheet during forming of the sheet material, and a sloping segment interposed between the parallel segments, the sloping segment allowing detection of the sheet material in a direction perpendicular to the feed direction of the sheet during forming of the sheet material, wherein said fold lines are compression lines having a recessed profile on an outer face of the material and a nonconvex profile on an inner face of the material, wherein each of said parallel segments forming a part of the optically detectable register mark is defined by at least a portion of one of said compression lines, and wherein the sloping segment forming at least a part of the optically detectable register mark is defined by at least a portion of one of the compression lines, the package further comprising a printed decoration, wherein said decoration comprises at least one printed area at least partly said enclosing compression lines and defining, with said compression lines and in contrast to said compression lines, said register mark.

8. A package as claimed in claim 7, wherein said register mark comprises four segments arranged to form a square; and the sloping segment extending along the diagonal of the square.

9. A package as claimed in claim 7, wherein at least a portion of two of the fold lines constitute the two parallel segments, and wherein at least a portion of one of the fold lines constitutes the sloping segment that is other than perpendicular to the feed direction.

10. A sheet material for producing packages of food products, the sheet material defining a feed direction representing the direction in which the sheet material is fed during production of the packages, the sheet material comprising:

a printed decoration;

a plurality of compression lines forming fold lines;

at least one optically detectable register mark at least partially defined by said compression lines and comprising:

at least two parallel segments of the compression lines extending perpendicular to the feed direction of the sheet material, the parallel segments allowing detection of the sheet material in the feed direction;

a sloping segment of one of the compression lines interposed between the two parallel segments, the sloping segment allowing detection of the sheet material in a direction perpendicular to the feed direction; and at least one printed area at least partially enclosing the two parallel segments and the sloping segment and defining, with said two parallel segments and the sloping segment and in contrast to the two parallel segments and the sloping segment, the optically detectable register mark.

11. A material as claimed in claim 10, wherein the compression lines have a recessed profile on a first face of the sheet material and a nonconvex profile on a second face of the material.

12. A material as claimed in claim 10, wherein the optically detectable register mark comprises four segments arranged to form a square, with the sloping segment extending along a diagonal of the square.

13. A sheet material for producing packages of food products, the sheet material defining a feed direction along which the sheet material is fed during production of the packages and comprising:

a printed decoration;

fold lines constituted by compression lines; and at least one optically detectable register mark at least partially defined by the compression lines, the optically detectable register mark comprising:

at least two parallel segments defined by compression lines extending perpendicular to the feed direction of the sheet material, the parallel segments allowing detection of the sheet material in the feed direction;

a sloping segment defined by a compression line interposed between the parallel segments, the sloping segment allowing detection of the sheet material in a direction perpendicular to the feed direction; and at least one printed area at least partially enclosing the compression lines and defining, with the compression lines and in contrast to the compression lines, the register mark.

14. A sheet material for producing packages of food products having a first face and a second face, said sheet material having a multilayer structure comprising:

a layer of paper material;

layers of heat-seal material covering both sides of said layer of paper material;

a layer of barrier material superimposed on one of said layers of heat-seal material;

a layer of heat-seal plastic material covering said layer of barrier material;

a number of fold lines constituted by compression lines, said compression lines defining a recessed profile on said first face of said material and a nonconvex profile on said second face of said sheet material; and at least one printed area constituting, together with said compression lines and in contrast with said compression lines, an optically detectable register mark, wherein said optically detectable register mark comprises:

at least two parallel segments defined by said compression lines, said two parallel segments extending perpendicular to a feed direction of said material, for allowing detection of the packaging material in said feed direction; and a sloping segment defined by said compression lines and interposed between said parallel segments, said sloping segment for allowing detection of the packaging material in a direction perpendicular to said feed direction, wherein said printed area encloses said two parallel segments and said sloping segment, and wherein said compression lines defining said two parallel segments and said sloping segment remain unprinted, so as to enable reading of said unprinted compression lines defining said two parallel segments and said sloping segment in contrast to said printed area.

* * * * *